US005497571A

United States Patent [19]

Tryon et al.

[11] Patent Number: 5,497,571

[45] Date of Patent: Mar. 12, 1996

[54] ILLUMINATED DISPENSER

[75] Inventors: John F. Tryon, Houston; James F. Reynolds, Plano, both of Tex.; Ralph R. Buoniconti, Jr., West Springfield, Mass.

[73] Assignee: Shell Oil Company, Houston, Tex.

[21] Appl. No.: 142,741

[22] Filed: Oct. 26, 1993

[51] Int. Cl.[6] ..... G09F 13/22; G09F 23/00

[52] U.S. Cl. ..... 40/544; 40/609

[58] Field of Search ..... 40/544, 609; 222/14, 222/29

[56] References Cited

U.S. PATENT DOCUMENTS

| | | | |
|---|---|---|---|
| 2,228,820 | 1/1941 | Griffith et al. | 222/14 X |
| 2,577,115 | 12/1951 | Eichner | 222/28 X |
| 2,799,954 | 7/1957 | Donnelly et al. | 40/609 X |
| 3,680,237 | 8/1972 | Finnerty, Sr. | 40/544 |
| 4,410,949 | 10/1983 | Huellinghorst et al. | 364/465 |
| 4,466,208 | 8/1984 | Logan, Jr. et al. | 40/544 |
| 4,856,392 | 8/1989 | Appelberg | 83/40 |
| 5,019,748 | 5/1991 | Appelberg | 315/169.3 |

*Primary Examiner*—Kenneth J. Dorner
*Assistant Examiner*—Cassandra Davis

[57] ABSTRACT

A panel assembly including a translucent panel and an electro-luminescent strip layered on the back of the translucent panel for imparting illumination to at least part of the translucent panel where the connection of the electro-luminescent strip to a power source results in illumination of the electro-luminescent strip and at least part of the translucent panel.

2 Claims, 3 Drawing Sheets

ILLUMINATED DISPENSER

FIELD OF THE INVENTION

The invention relates to a system for illuminating a graphic and translucent panel, especially a graphic and panel which are part of a retail gasoline dispenser.

BACKGROUND OF THE INVENTION

Gasoline dispenser pumps are used in gasoline service stations to transfer the gasoline from the gasoline reservoir to the fuel tank of the customer's vehicle. Since gasoline is a flammable liquid, safety regulations limit the type of lighting that may be used in and around the dispenser. These regulations protect customers and employees from unsafe lighting systems which could ignite the gasoline in normal service or if a leak developed in the dispenser.

The limitations on such lighting cause corresponding limitations on the type of lighted advertising graphics which may be used on and around the gasoline dispenser. Fluorescent or incandescent light fixtures could light graphics on portions of the dispenser. It would be difficult, however, to meet the safety regulations with such lighting sources. The safety regulations include limits on the maximum voltage used in lighting advertising graphics. Another problem with those sources is their size. The lower door of the gasoline dispenser is a prime area for applying advertising graphics such as the company name and/or company trade or service mark. Yet there is only a very limited area behind the lower door for installing lighting apparatus.

Accordingly, it would be advantageous to have a safe and space-conserving lighting apparatus for use in applying lighted advertising graphics to the lower door of a gasoline dispenser pump.

SUMMARY OF THE INVENTION

The invention relates to a panel assembly including a translucent panel and an electro-luminescent strip layered on the back of the translucent panel for imparting illumination to at least part of the translucent panel where the connection of the electro-luminescent strip to a power source results in illumination of the electro-luminescent strip and at least part of the translucent panel. One aspect of the invention is affixing the panel assembly to a gasoline dispenser pump lower door on one or more sides of the dispenser.

DETAILED DESCRIPTION OF THE INVENTION

A. Panel Assembly

Figure 1:
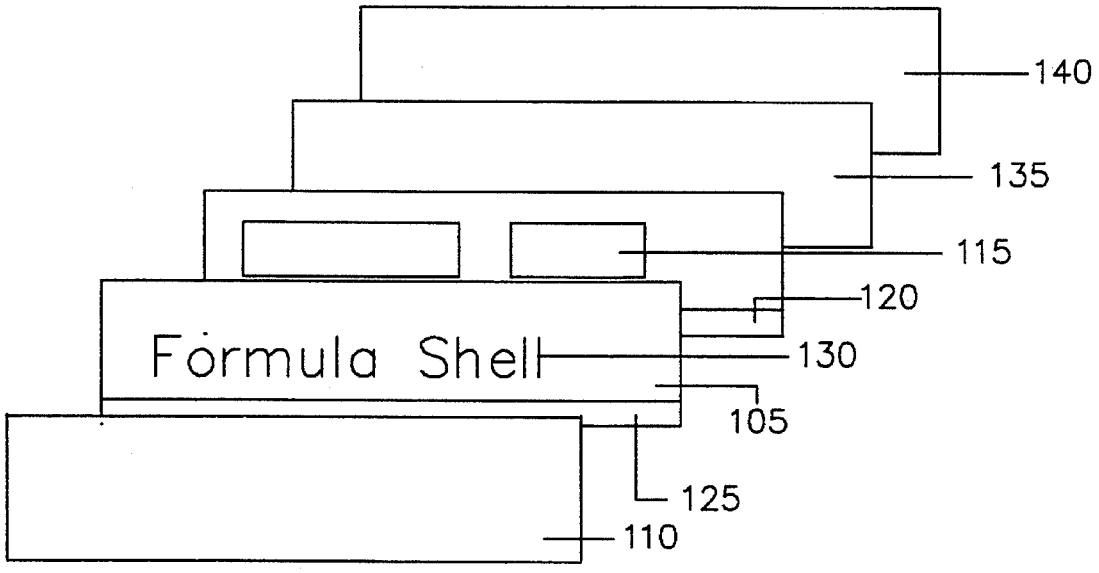
FIG. 1 is an exploded view of one embodiment of the panel assembly.

The panel assembly of the invention in one embodiment of the invention is discussed in detail below. In FIG. 1, graphic 105 is layered behind translucent panel 110 so as to impose a partly translucent, partly opaque graphic 105 on the translucent panel 110. Graphic 105 is applied by any conventional graphic means such as a label or silkscreen. Silkscreening is the most common and economical means of applying a graphic. Where the graphic is applied to a label, the label is layered on translucent panel 110 by any conventional means such as by an adhesive.

Translucent panel 110 is any conventional plastic, but preferably is a very strong material such as polycarbonate. General Electric sells one embodiment of a polycarbonate plastic panel under the tradename "LEXAN." Layered on the back of graphic 105 are electro-luminescent strips 115, 118, and 120. These strips are layered on the back of graphic 105 by any conventional means such as an adhesive, or by any conventional attachment means such as tacking. The number of electro-luminescent strips used can be one or more and will vary depending on the type of graphic being illuminated. Such electro-luminescent strips are known in the art from U.S. Pat. Nos. 4,856,392 and 5,019,748. The disclosure in these two patents are incorporated herein by reference. When used in a gasoline dispenser pump, the use of the electro-luminescent strips is typically governed by U.L. Specification No. 913 (or corresponding regulations, if any) safety regulations. The current through each of the electro-luminescent strips and the associated voltage and AC frequency, individually, is adjusted so as not to exceed U.L. Specification No. 913 (as the specifications are applied to a propane environment).

The dimensions of the electro-luminescent strips will vary depending on their application. The dimensions of electro-luminescent strips 115 and 118, in one embodiment, are about 3.375 inches by about 11.5 inches. The dimensions of electro-luminescent strips 120, in one embodiment, are about 1 inch by about 38 inches. Since the entire electro-luminescent strip is a conductor, the current through the electro-luminescent strips is determined on a square inch basis. That is, the current through a square inch of a electro-luminescent strip is multiplied by the total number of square inches in the electro-luminescent strip to determine the total current through the electro-luminescent strip.

The thickness may vary but is typically about 0.018 inches. The thickness is substantially constant and thus is not critical in determining total current. For electro-luminescent strips 115 and 118 having the dimensions of about 3.375 inches by about 11.5 inches, the voltage and frequency can be adjusted to obtain a unit current in each electro-luminescent strip of about 14.55 mA. Where necessary to limit electrical surges, a "surge protector" type circuit (not shown) is inserted as an additional safety feature in each of the respective power lines leading to each electro-luminescent strip. Various conventional surge protection circuits are known to those skilled in art.

The panel assembly operates by connecting electro-luminescent strips 115, 118, and 120 each to individual power sources (not shown). The strips are layered on the back of graphic 105, for imparting illumination to at least part of graphic 105 and translucent panel 110. The illuminated strips 115, 118, and 120 cause light to pass through graphic 105 and translucent panel 110. In FIG. 1, the graphic 105 forms letters of the alphabet 130 and horizontal line 125. The light passes from strips 115, 118, and 120 and through graphic 105 and panel 110, thus illuminating the letters and line of graphic 105.

Optionally, protective sheet 135 is layered by any conventional means behind electro-luminescent strips 115, 118, and 120. Protective sheet 135 serves to safeguard electro-luminescent strips 115, 118, and 120 from dust and/or moisture or other contaminants present in cavity 330 (see FIG. 2*b*) and from accidentally short circuiting. Protective sheet 135 is made of any conventional material suitable as a protective dust layer, such as vinyl or other plastic sheeting. Another option is to have metal sheet 140 layered behind electro-luminescent strips 115, 118, and 120 and/or protective sheet 135. Sheet metal 140 can serve as a backing to support the panel assembly. Metal sheet 140 is optionally fixedly attached to portions of lower door 310 (see FIG. 3*a*).

B. Panel Assembly Affixed to Gasoline Dispenser Pump

Figure 2B:
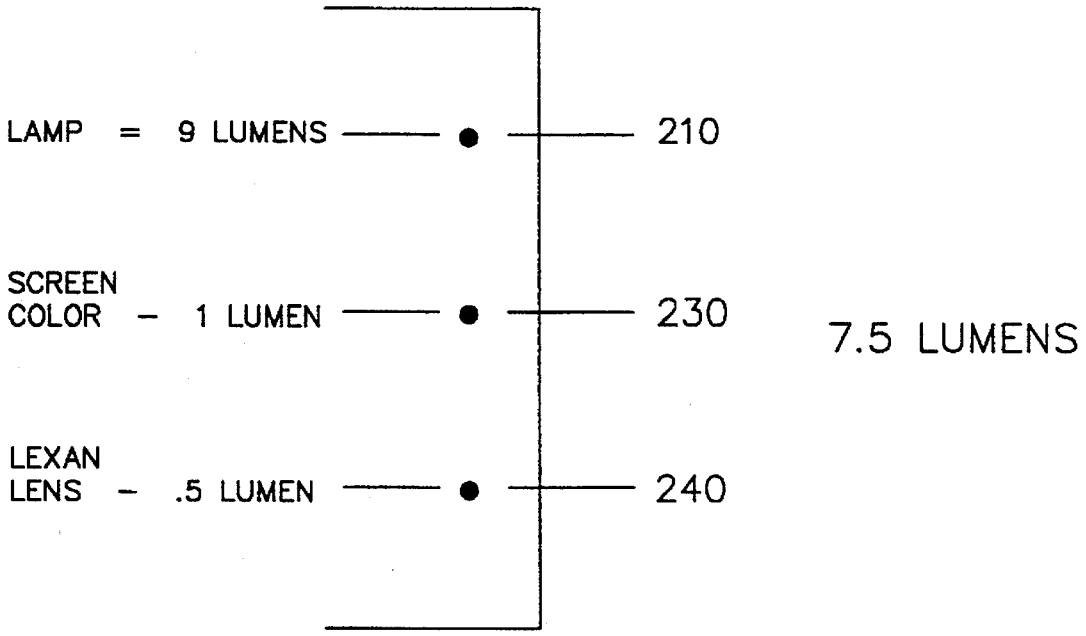
Figure 3A:
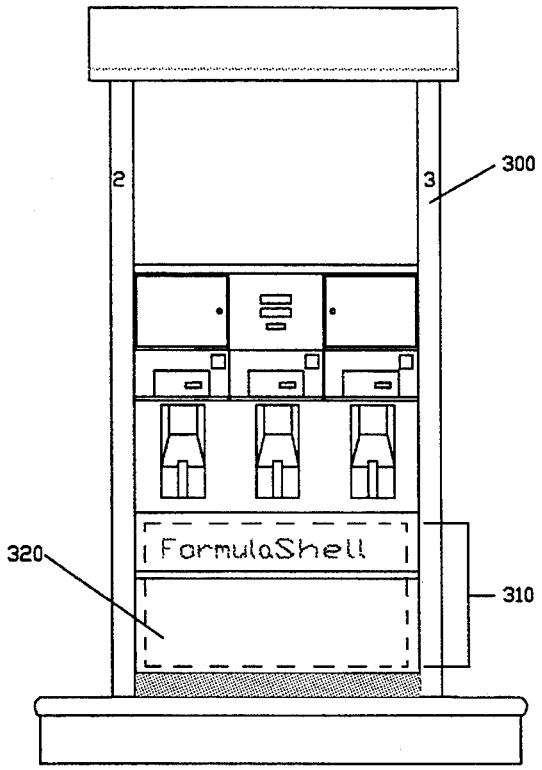
FIGS. 3*a* and 3*b* depict a front view and a side view of one embodiment of the panel assembly affixed to the lower door of a gasoline dispenser pump.
Figure 3B:
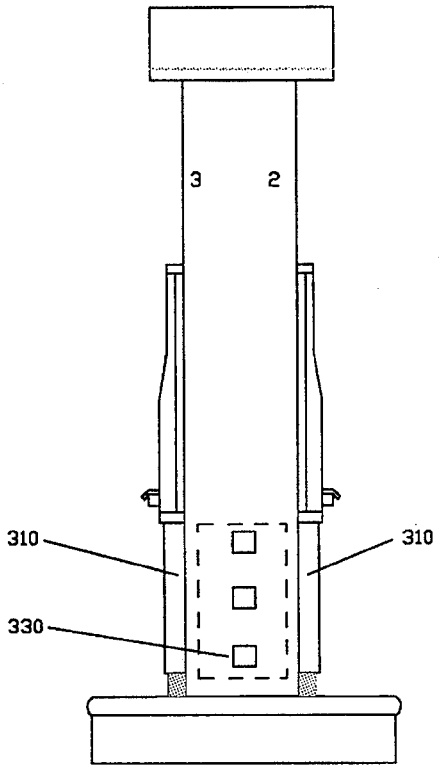

In FIGS. 3*a* and 3*b*, an embodiment of the invention is shown where the panel assembly is affixed to the lower door of a gasoline dispenser pump. In FIG. 3*a*, gasoline dispenser pump 300 houses lower door 310. Panel assembly 320 is affixed to lower door 310. The attachment may be by any conventional means. Panel assembly 320 is optionally recessed from, or substantially flush with, the outer surface of lower door 310. When recessed, the amount of recess is limited to the available space behind lower door 310 since pump apparatus occupies most of cavity 330 (FIG. 2*b*) behind lower door 310.

Typically, as indicated in FIG. 3*b*, pump 300 will have two lower doors 310. They are typically mounted on opposite sides of pump 300. As a result, panel assembly 320 is optionally removably mounted on one or two sides of gasoline dispenser pump 300.

As depicted in FIG. 3*b*, the sides of a lower portion of gasoline dispenser pump lower doors 310, and other side portions, define sides of cavity 330. The panel assembly is removably mounted on a lower portion of gasoline dispenser pump 300, i.e., lower door 310. Thus, a back portion of panel assembly 320 defines one side of cavity 330.

The panel assembly is maintained either by rear or frontal access. Where metal sheet layer 140 is used (see FIG. 1), rear access is possible where it is removably attached to lower door 310. Frontal access is possible where translucent panel 110 is removably mounted.

The panel dimensions are adjusted as necessary to fit the particular gasoline dispenser pump. When used in gasoline dispenser pump 300, the panel assembly dimensions are as follows (reference FIG. 1): (1) Translucent panel 110 is from about 5 inches to about 20 inches in height, from about 20 inches to about 72 inches in length, and from about 0.005 inches to about 0.25 inches in thickness. The height and length of graphic 105, protective sheet 135 and metal sheet 140 all correspond to the height and length of translucent panel 110. Electro-luminescent strips 115 and 118 have substantially the same dimensions. These dimensions are from about 1 inches to about 10 inches in height and from about 5 inches to about 36 inches in length. Electro-luminescent strips 120 has different dimensions. These are from about 0.5 inches to about 5 inches in height and from about 10 inches to about 72 inches in length.

C. Layers in Panel Assembly and Lumen Levels

Figure 2A:
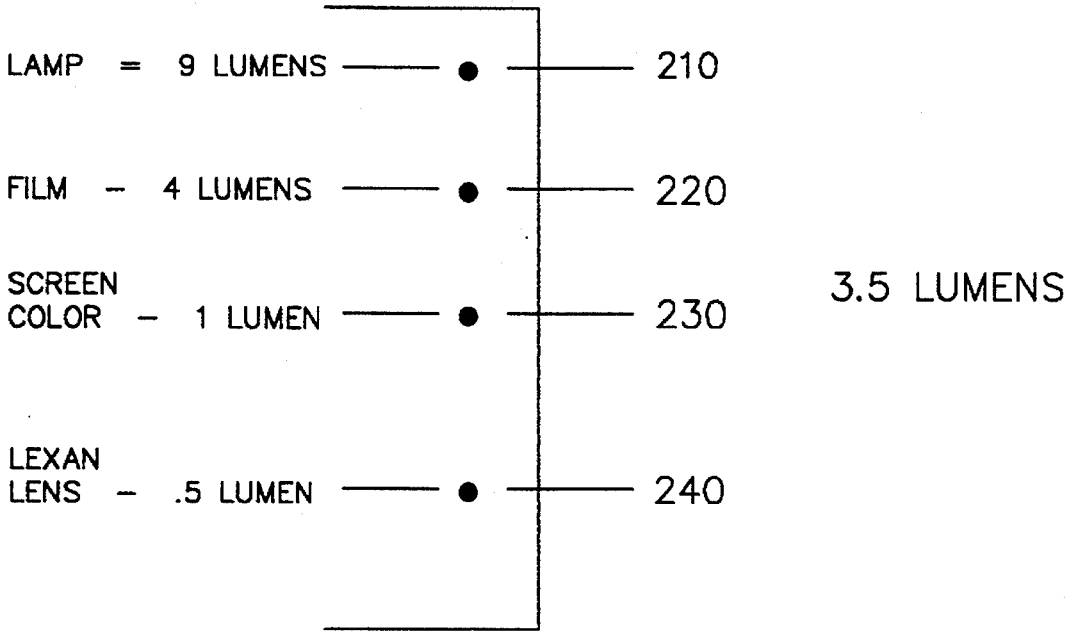
FIGS. 2*a* and 2*b* show two schematic embodiments of the panel assembly and the lumens produced by the electro-luminescent strip and the lumens lost as the light passes through the other layers of the assembly.

FIG. 2*a* depicts the layers of elements in one embodiment of the panel assembly of the invention. In this embodiment, electro-luminescent strip 210 produces about 9 lumens. The graphic is a decal, which includes plastic film 220 which has been coated with a screen color 230 from a silkscreening process. The film 220 absorbs about 4 lumens and the screen color 230 absorbs about 1 lumen. The translucent panel in this embodiment is LEXAN lens 240. This lens absorbs about 0.5 lumens. Thus, the remaining total lumen intensity is about 3.5 lumens.

FIG. 2*b* shows the same assembly except that film 220 is eliminated. This is accomplished be applying the graphic directly to translucent lens 240, for example, by a silkscreening process. Eliminating film 220 thus saves the 4 lumens absorbed by the film. Thus, in FIG. 2*b* the remaining total lumen intensity is about 7.5 lumens.

What is claimed is:

1. A panel assembly having front and back portions for illumination, said panel assembly comprising:

(a) a translucent panel having front and back portions; and (b) an electro-luminescent strip layered on the back of said translucent panel for imparting illumination to at least a portion of said translucent panel; and (c) layer attachment means for layering said electro-luminescent strip on the back of said translucent panel;

(d) a gasoline dispenser pump, having at least two sides and having an upper and having a lower portion having a cavity therein; and said gasoline dispenser pump having a lower door disposed in said lower portion; wherein said panel assembly is removably mounted on said lower door of said gasoline dispenser pump;

(e) attachment means for removably mounting said translucent panel to said lower door of said gasoline dispenser pump; and (f) wherein said panel assembly is removably mounted on said lower portion of said gasoline dispenser pump, and wherein said back portion of said panel assembly defines at least a portion of one side of said cavity in said lower portion of said gasoline dispenser pump.

2. A gasoline dispenser pump having an illuminated panel assembly incorporated therein, said panel comprising:

(a) a gasoline dispenser pump, having at least two sides and having upper and lower portions, said lower portions having a recess therein;

(b) a translucent panel, having front and back portions, removably attached to at least one of said sides of said gasoline dispenser pump;

(c) attachment means for removably mounting said translucent panel to said at least one of said sides of said gasoline dispenser pump;

(d) a graphic member, having front and back portions and having translucent portions and opaque portions; wherein said graphic member is layered on the back of said translucent panel, for limiting illumination of the translucent panel; and (e) an electro-luminescent strip layered on the back of said graphic member, for imparting illumination to at least a portion of said translucent panel;

(f) layer attachment means for layering said electro-luminescent strip on the back of said graphic member;

(g) a power source;

(h) wherein said translucent panel, attachment means, graphic member, electro-luminescent strip, and layer attachment means are configured so that connection of said electro-luminescent strip to a said power source results in illumination of said electro-luminescent strip and at least a portion of said translucent panel;

(i) wherein said translucent panel, graphic member, and electro-luminescent strip are removably mounted on said at least one side of said gasoline dispenser pump; and (j) wherein said translucent panel, graphic member, and electro-luminescent strip are disposed in said recess in said lower portion of said side of said gasoline dispenser pump.

* * * * *